US007989787B2

(12) United States Patent
Forster

(10) Patent No.: US 7,989,787 B2
(45) Date of Patent: Aug. 2, 2011

(54) STRUCTURE ELEMENT, IN PARTICULAR FOR RADIATION SHIELDING CONSTRUCTIONS

(76) Inventor: Jan Forster, Ingolstadt (DE)

( * ) Notice: Subject to any disclaimer, the term of this patent is extended or adjusted under 35 U.S.C. 154(b) by 246 days.

(21) Appl. No.: 12/297,257

(22) PCT Filed: Apr. 23, 2007

(86) PCT No.: PCT/EP2007/053949

§ 371 (c)(1),
(2), (4) Date: Oct. 15, 2008

(87) PCT Pub. No.: WO2007/122215

PCT Pub. Date: Nov. 1, 2007

(65) Prior Publication Data

US 2009/0278063 A1 Nov. 12, 2009

Related U.S. Application Data

(60) Provisional application No. 60/794,636, filed on Apr. 25, 2006.

(51) Int. Cl.
*G21F 3/00* (2006.01)

(52) U.S. Cl. ..... 250/517.1; 52/741.3

(58) Field of Classification Search ..... 250/517.1, 250/518.1, 515.1, 505.1; 52/741.3, 742.14
See application file for complete search history.

(56) References Cited

U.S. PATENT DOCUMENTS

| | | | | |
|---|---|---|---|---|
| 5,416,333 | A * | 5/1995 | Greenspan | 250/515.1 |
| 6,630,683 | B2 * | 10/2003 | Vanvor | 250/518.1 |
| 2005/0218348 | A1 * | 10/2005 | Fehrenbacher et al. | 250/517.1 |

FOREIGN PATENT DOCUMENTS

| | | |
|---|---|---|
| CH | 543161 | 10/1973 |
| DE | 10120368 | 11/2002 |
| DE | 10327466 | 8/2004 |
| DE | 102004052158 | 4/2006 |
| DE | 102004063185 | 4/2006 |
| GB | 2117964 | 10/1983 |
| GB | 2124272 | 2/1984 |

OTHER PUBLICATIONS

English translation of International Preliminary Examination Report on Patentability, issued Dec. 24, 2008.

* cited by examiner

*Primary Examiner* — Kiet Nguyen
(74) *Attorney, Agent, or Firm* — Dority & Manning, P.A.

(57) ABSTRACT

There is a structure element, in particular for radiation shielding constructions, having at least one floor plate and at least one wall section and/or at least one ceiling section. The structure element is characterized in that the at least one wall section and/or the at least one ceiling section comprise/comprises at least two shell elements made from metal, plastic and/or wood and a layer which lies in between and is made from radiation shielding materials. In addition, a construction, in particular a radiation shielding construction, is proposed having at least one floor plate and/or ceiling plate which delimits a storey and a structure element described above.

21 Claims, 17 Drawing Sheets

STRUCTURE ELEMENT, IN PARTICULAR FOR RADIATION SHIELDING CONSTRUCTIONS

CROSS-REFERENCE TO RELATED APPLICATIONS

This application claims priority to U.S. Provisional Patent Application No. 60/794,636 filed Apr. 25, 2006, and International Application Serial No. PCT/EP2007/053949 filed Apr. 23, 2007.

TECHNICAL FIELD

The invention relates to a structure element, in particular for radiation shielding constructions, having at least one floor plate and at least one wall section and/or at least one ceiling section.

BACKGROUND

Structure elements of the generic kind are used primarily in the industrial, medical and research fields and are always used in cases where it is required to prevent radiation, produced for example by particle accelerators or medical radiation devices, from leaving a defined area.

Conventionally, solid concrete or steel-reinforced concrete structures have been built in the manufacture of such structure elements. In order to reduce construction costs while maintaining reliable screening from radiation, DE 103 27 466 A1 proposes to manufacture the structure element in a sandwich-type construction, wherein one layer of the relevant parts of the building is manufactured from radiation shielding material and at least one further layer is made from (steel-reinforced) concrete. A construction of this type has various advantages, in particular in the form of lower construction costs. But, in both conventional structure elements as well as in constructions that are made in a steel-reinforced sandwich-type construction, the geometry of the finished structure element must be already known prior to the fabrication of the individual components. Retrospective changes or the assembly of the structural element at another site are certainly possible, but involve relatively high costs.

OBJECTS AND BRIEF SUMMARY

The problem addressed by the present invention is therefore to propose a structure element, in particular for radiation shielding constructions, which consists of individual components that can be combined with one another in a flexible way, such that the geometry of the structure element can also be retrospectively modified easily and cost-effectively.

This problem is solved by the features of the independent claims.

According to the invention it is proposed that the at least one wall section and/or the at least one ceiling section comprise(s) at least two shell elements made of metal, plastic and/or wood and a layer which lies in between and is made from radiation shielding material. This results in a number of advantages. First, the individual shell elements can be manufactured very flexibly and at very low cost. Also, when steel or a high-strength plastic is used, the relevant parts of the building have a relatively small wall thickness compared to building parts made of concrete or steel-concrete, due to the high stability of the shell material used. In addition; the individual components ran be designed in a very flexible way. While the use of concrete only allows the manufacture of shell elements with essentially flat surfaces, the components according to the invention can have almost any geometrical form, which means that structure elements can be produced that are individually matched to the prevailing conditions.

It is advantageous if these shell elements are joined to the floor plate and/or to additional shell elements by means of detachable connections, in particular screws, hooks and/or plug and socket connections. Welding of the individual sections is of course also conceivable. Using the proposed type of connection, particularly high flexibility of the structure element is achieved. Its geometry can be adapted to the existing requirements at any time using an appropriate combination of the individual sections. For this purpose, only the appropriate connections between the respective shell elements need to be disconnected. The shell elements themselves can be subsequently easily dismantled and repositioned relative to one another and reconnected as necessary, which means that virtually any structure element geometry can be implemented. In addition, after dismantling of the structure element the individual shell elements can also be used for other purposes since, in contrast to shell elements made of concrete, they do not need to be destroyed.

It is also advantageous if the connection is formed by means of struts, in particular angled ones. These struts are advantageously connected to more than two shell elements of the wall and/or ceiling sections and span across them, which means that the stability of the structure element can be additionally increased.

If the connection comprises profiles, in particular omega profiles, this results in a connection of the shell elements that is easy to assemble or disassemble. For this purpose, appropriate shell regions of the wall sections and/or of the at least one ceiling section and/or the floor plate have profiled sections, for example folds, which interact with the respective profiles. The profiles in this arrangement need only be pushed on to the corresponding adjacent profiled sections of the said regions, and subsequently ensure a reliable and easily detachable connection.

Particular advantages are equally well obtained if the shell elements have an essentially corrugated profile. This means that their stability is significantly increased in comparison to flat plate-like shell elements. Finally, this leads to considerable savings in materials and therefore also costs in the manufacture of the structure element. Moreover, standard components, such as conventional bulkheads made of steel, can be used, which can also be used for other purposes after dismantling of the structure element.

It is also advantageous in this context if the shell elements enclosing the radiation shielding material are joined together, in particular using detachable tie-rods arranged transversely to their longitudinal direction. This allows the stability of the relevant components to be markedly increased, which is essential particularly in the case of thick components with a high proportion of radiation shielding material. The tie-rods used are advantageously screwed or welded together with the adjacent shell elements. In addition or alternatively, the shell elements can also have retainers to which the tie-rods are connected using a plug connection and/or keyed joint. The tie-rods can also of course be hooked into appropriate retainers.

In a particularly advantageous embodiment the tie-rods have a Z-, T- or U-section, from which a particularly high stability can be guaranteed for the lowest possible material cost.

It is particularly advantageous if the wall sections and/or ceiling sections have standardised dimensions. This allows structure elements to be erected along the lines of a modular system in a particularly simple way. Also, the manufacture of the corresponding sections and their transport are considerably simplified, which is reflected not least in lower costs. In particular, if the wall sections and/or the at least one ceiling section have a constant thickness, the individual sections can be combined with one another as desired.

If the nature of the radiation shielding material inside the structure element varies, in particular with the type of radiation and/or radiation intensity, then individual adaptation can be made to the radiation conditions inside the separate regions of the structure element, while at the same time keeping the wall thickness of the individual sections constant. Even a retrospective adaptation of the shielding effect of the respective components is thereby possible at any time. For this purpose, the radiation shielding material at the corresponding point of the structure element need only be replaced by a radiation shielding material adapted to the current radiation conditions. Replacement of the entire building part is therefore no longer necessary.

It is furthermore advantageous if the radiation shielding material contains mineral substances, which, owing to their petrographic properties, in particular their atomic number and/or specific density, are particularly suitable for radiation shielding material. The widest range of materials can therefore be used. The radiation shielding material can thus either be selected according to the radiation to be shielded, or also according to the materials available at the construction site. This means that economic aspects can also be considered. It is thus conceivable for example to use conventional limestone ($CaCO_3$) chips, if this can be acquired relatively easily and/or cheaply. Materials such as barite or iron ore have also proved outstandingly suitable, owing to their high specific density.

In order to ensure a particularly reliable radiation shielding owing to the presence of hydrogen atoms, it is advantageous if the radiation shielding contains water. In particular, if the water is bound to a solid substrate material, the radiation shielding material can be easily handled. Water damage, caused by possible leakiness of the components, can also be easily prevented.

The use of calcium carbonate (lime) is also advantageous. Despite its high water content this has a relatively high density, so that calcium carbonate, in particular in compressed form, is outstandingly suitable as a radiation shielding material.

Advantageously, the radiation shielding material comprises natural unbaked calcium sulphate dihydrate. Owing to its low costs and high water-binding capacity, natural gypsum is also particularly suited as a radiation shielding material. Of course, so-called REA-gypsum can also be used.

It is also advantageous if the radiation shielding material comprises a ballast made of hardened granulated gypsum. Gypsum of this kind is not only easier to transport, but also particularly easy to process. The above mentioned advantages with respect to the radiation screening are preserved with this material.

It is particularly advantageous if the radiation shielding material is compressed. This significantly increases the homogeneity of the relevant material. It can also prevent cavities arising inside the components, which would significantly reduce the radiation-screening effect.

If additives of materials such as gibbsite, hydrargillite, aluminium hydrate or magnesium sulphate are added to the radiation shielding material, the effect of the radiation shielding material can be further increased.

Particular advantages are furthermore obtained from using an elastic mounting of the floor plate. This allows the relevant structure element to be effectively decoupled from external oscillations and/or vibrations. This has a particularly important advantage if highly sensitive radiation sources are used within the structure element. In this way, particularly in earthquake affected areas, absorption and dissipation of the seismic energy applied to the construction can be guaranteed, which is not the case for radiation shielding constructions constructed in the conventional way.

This type of mounting advantageously comprises at least one elastic material, at least one spring element and/or at least one shock absorber. The type of damping can be chosen based on the size of the structure element or of the expected oscillations and/or vibrations in the environment. Combinations of various damping elements are of course possible. Other constructions that absorb the transmitted energy by friction are equally conceivable.

If the wall sections in the region of an entrance opening are arranged relative to one another in such a way that a labyrinth-like access is formed, the radiation can advantageously be prevented from leaving the structure element. An entrance is simultaneously proposed which dispenses with a radiation-shielding and therefore expensive construction for sealing off the entrance opening. The labyrinth-like access is advantageously created in such a way that the wall sections adjacent to the entrance opening are offset relative to one another in such a way that a part of at least one wail section is located in the radiation path of the radiation source, such that the leaked radiation cannot directly strike the door panel.

It is furthermore advantageous if the at least one ceiling section is fixed, in particular detachably, to transverse and/or longitudinal bearers, wherein the transverse and/or longitudinal bearers are at least partially supported on the wall sections. This results in a number of crucial advantages. For one, the aforementioned bearers offer a simple facility to support the at least one ceiling section, which can be very heavy owing to appropriate radiation shielding material, without the use of supporting pillars. In addition, the integration of transverse and/or longitudinal bearers in the ceiling region of the structure element means that stable fixing points are available. These can be used for example for attaching to a crane, or for the attachment of other pieces of equipment necessary for operating the radiation source and/or the structure element. The bearers can each separately rest on the corresponding wall sections. It is also of course conceivable that just the longitudinal or solely the transverse bearers are supported on the wall sections, and that as well as for attaching the shell elements of the ceiling sections, they are also used for supporting the remaining bearers. The transverse and/or longitudinal bearers can furthermore also contribute to the radiation shielding. For instance if the ceiling section has multiple shell elements that are combined together, then at each of the corresponding junction points a joint is present, whose width can be up to 2 to 3 mm overall. These joints are therefore arranged advantageously directly underneath or above the aforementioned bearers, in such a way that reliable radiation shielding can be guaranteed over the entire ceiling section.

A construction according to the invention with at least one base plate and/or ceiling plate bounding a storey is characterized in that it has a structure element with the features described above.

In order to keep the building costs of the construction as low as possible and to be able to integrate the structural element according to the invention into the construction even under conditions of restricted space, it is advantageous if the structural element is integrated into the base plate and/or the ceiling plate of the construction in such a way that the surface of the floor plate together with the surface of the base plate, and/or the surface of the ceiling section together with the surface of the ceiling plate, form an essentially flat surface. This means that the floor plate and/or the ceiling section of the structure element assume not just the function of radiation shielding, but also serve as an integral component of the base plate and/or ceiling plate bounding a storey of the construction. If two or more structure elements are to be housed in storeys of the construction lying on top of one another, this also makes it possible to use the ceiling section of the lower structure element as the floor plate of the upper structure element.

If the construction is only to be equipped with one or more structural elements according to the invention at a later date, then it is recommended that the floor plate has interfaces for later fixing of the shell elements. These retainers can be screwed to the floor plate for example in the form of angles, which can be used for later fixing of the shell elements. Naturally any other interfaces are conceivable, for example retainers for plug connections or metal plates, to which the shell elements of the structure element can later be welded or attached in a comparable way. In this context it is advantageous if the floor plate is recessed into the base plate. In this way the base plate, including the interfaces, is already integrated into the construction at the fabrication stage, without the footprint of the construction thereby being occupied unnecessarily. If the integration of a structure element according to the invention within the construction is desired at a later date, then this can easily be erected on the floor plate that is recessed in the floor of the construction.

In this context further advantages are obtained if the interfaces and/or the floor plate are covered by at least one covering layer, in such a way that the surface of the covering layer forms an essentially flat surface with the surface of the base plate of the construction. By this process a flat surface is obtained on the relevant areas within the construction, since the existing interfaces for the erection of a subsequent structure element, or the corresponding associated floor plate of the structure element, are completely covered. The covering layer can be manufactured from the widest range of materials, for example floor screed, wood or a similarly easily removable material. It is potentially advantageous if a separating layer is incorporated between the covering layer and the floor plate, which simplifies the detachment of the covering layer.

BRIEF DESCRIPTION OF THE DRAWINGS

In the following the invention is explained with the aid of diagrams. Shown are.

DETAILED DESCRIPTION OF EXEMPLARY EMBODIMENTS

Figure 1:
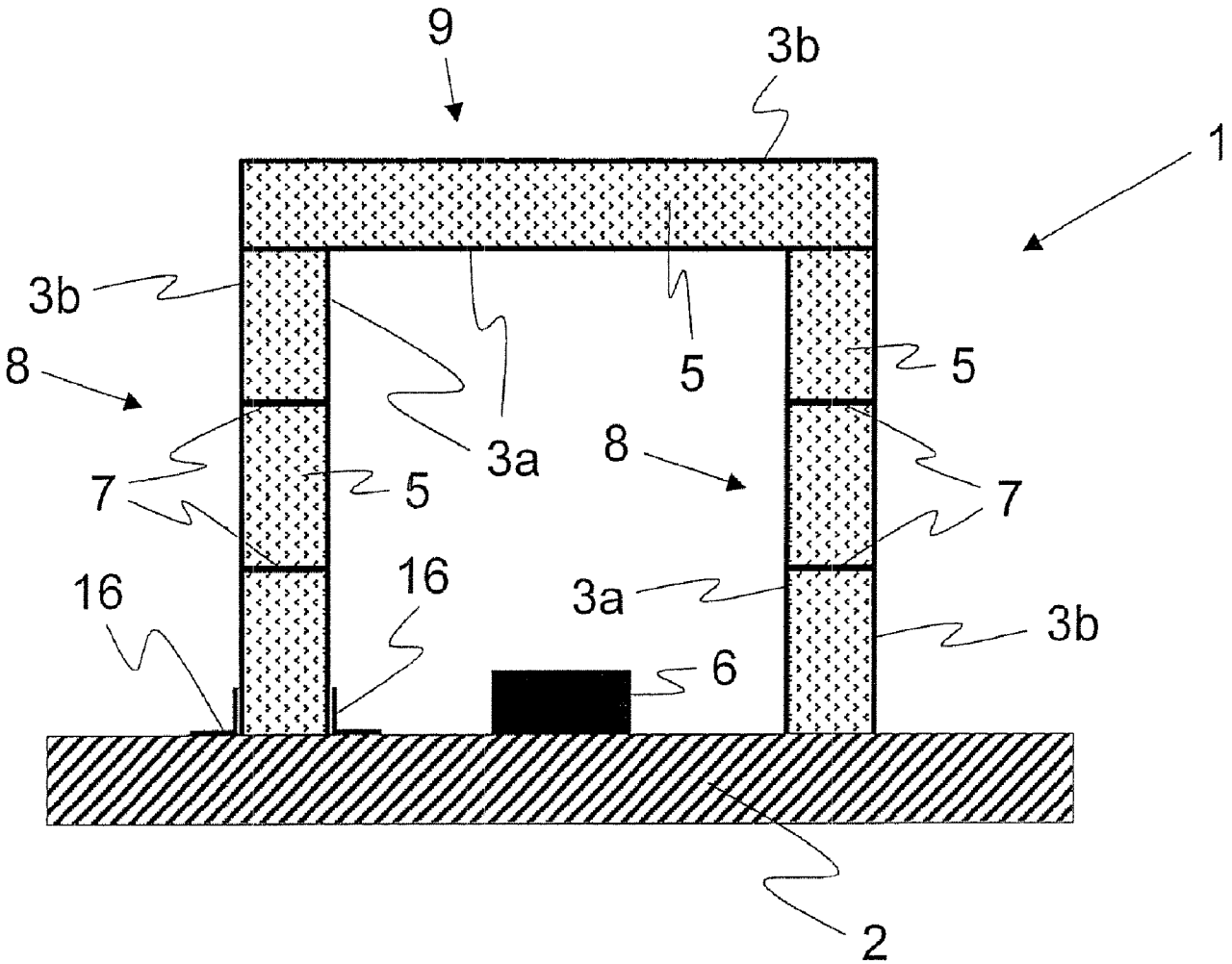
FIGS. 1 and 2 cross-section drawings of structure elements according to the invention, FIG. 3 a cross-section drawing of a structure element according to the invention with an elastically mounted floor plate, FIGS. 4 to 6 cross-section drawings of structure elements according to the invention, integrated into a construction, FIGS. 7 to 13 plan views of structure elements according to the invention, FIG. 14 a schematic plan view of a wall section, FIG. 15 types of connection between adjacent shell elements, FIG. 16 a perspective view of shell elements connected by means of struts, and FIG. 17 a further cross-section drawing of a structure element according to the invention.

FIG. 1 shows a cross-section representation of a structure element 1 according to the invention, with a floor plate 2 and inner shell elements 3*a* and outer shell elements 3*b* made of metal, in particular steel. The shell elements 3*a*, 3*b* on the left-hand side of the structure element 1 are connected to the floor plate 2 by means of angle elements 16 with the aid of screws, not shown. Angle elements 16 of this kind can of course also be located on the points of contact between wall section 8 and ceiling section 9, or in the corner regions of two adjoining wall sections 8. A radiation shielding material 5 is located between the inner and outer shell elements 3*a*, 3*b*. The components consisting of shell elements 3*a*, 3*b* and the intermediate layer of radiation shielding material 5 serve to shield against radiation 15, which is generated in the interior of the structure element 1 by a radiation source, for example a linear accelerator 6. In order to increase the stability of the component, the shell elements 3*a*, 3*b* are joined together by means of tie-rods 7 arranged transversely to their longitudinal direction. These can be screwed or welded to the shell elements 3*a*, 3*b*. Retainers, not shown, in the area of the shell elements 3*a*, 3*b* are also conceivable, which the tie-rods 7 are simply hooked into. In addition, various types of plug connections can likewise be used. In the same way, the shell elements 3*a*, 3*b* are also joined to the floor plate 2, which can also have special retainers for this purpose.

Figure 2:
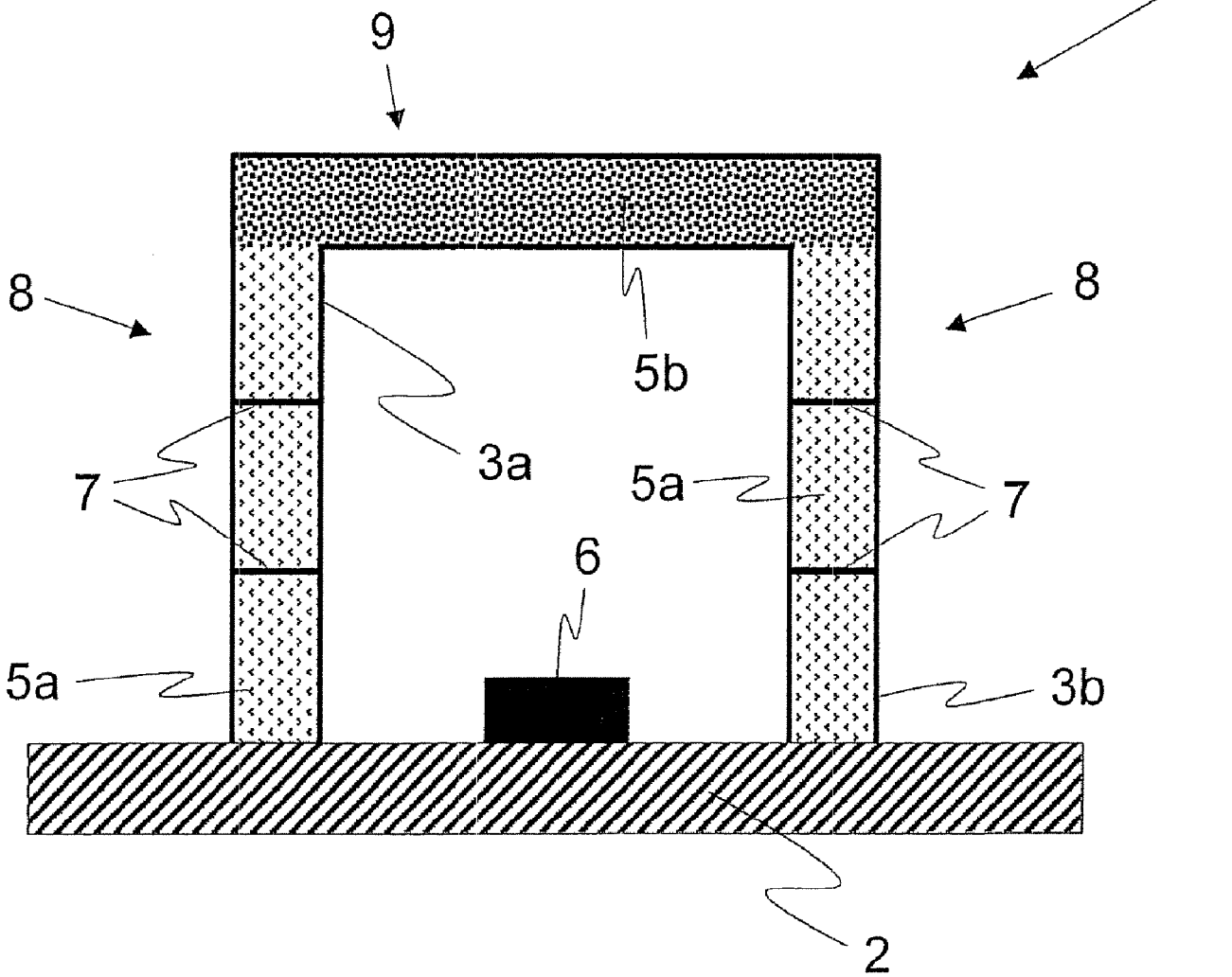

While the radiation shielding material 5 is homogeneously distributed between the shell elements 3*a*, 3*b* in FIG. 1, FIG. 2 shows a comparable structure element 1 wherein two different radiation shielding materials 5*a*, 5*b* are used. This means that allowance can be made for the individual radiation distribution inside the structure element 1. If the radiation 15 is emitted by the radiation source for example in a primarily horizontal direction, it is then advantageous to fill the wall sections 8 with a radiation shielding material 5*a* which guarantees high radiation screening, while inside the ceiling section 9 a radiation shielding material 5*b* can be used that only needs to satisfy low demands in terms of radiation screening. By means of this adaptation the costs of the structure element 1 can be further reduced. Naturally, the radiation shielding materials 5*a* used in individual wall sections 8 can have different properties, wherein alternatively or additionally, the radiation shielding material 5*a*, 5*b* used within a wall section 8 and/or a ceiling section 9 can also vary according to the prevailing conditions. Retrospective replacement of the radiation shielding material 5*a*, 5*b* is of course also conceivable and easily possible owing to the construction of the structure element 1 according to the invention. While the inner shell element 3*a* of the ceiling section 9 closes off the wall sections 8 in FIG. 1 to the top, FIGS. 2 to 6 each show ceiling sections 9, whose inner shell element 3*a* is essentially flush with the inner shell elements 3*a* of the wall sections 8. Both variants are of course realisable according to requirements.

Figure 3:
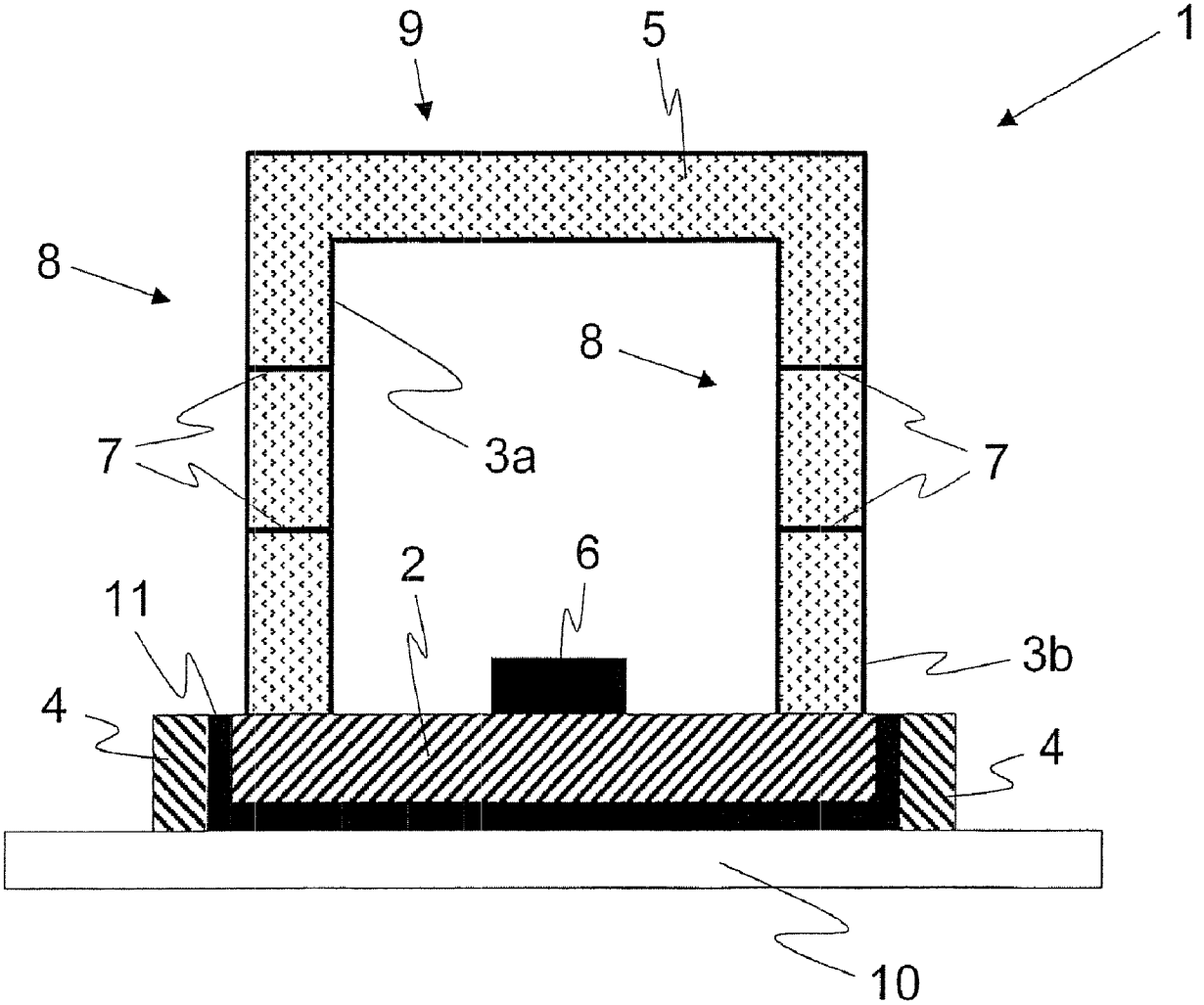

FIG. 3 also shows a structure element 1 according to the invention. In order to prevent tremors and/or vibrations from being transmitted to the structure element 1 and thereby on to the radiation source or other components therein, the floor plate 2 is elastically mounted. To ensure an appropriately reliable decoupling of the structure element 1 from the surroundings, between the floor plate 2 and sub-floor 10, which is formed for example by a ceiling or foundation of the building, a layer of elastic material 11 is incorporated, in turn surrounded by an enclosure 4, which however serves only for laterally bounding or mounting the elastic material 11. The elastic material 11 itself can be chosen from a variety of materials in accordance with the vibrations and/or tremors to be expected. Conceivable materials are for example various plastics (elastomers), types of rubber or other absorbent materials known to the person skilled in the art. Alternatively or additionally, damping elements such as springs, shock absorbers or elements that absorb vibrations based on friction can be used.

Figure 4:
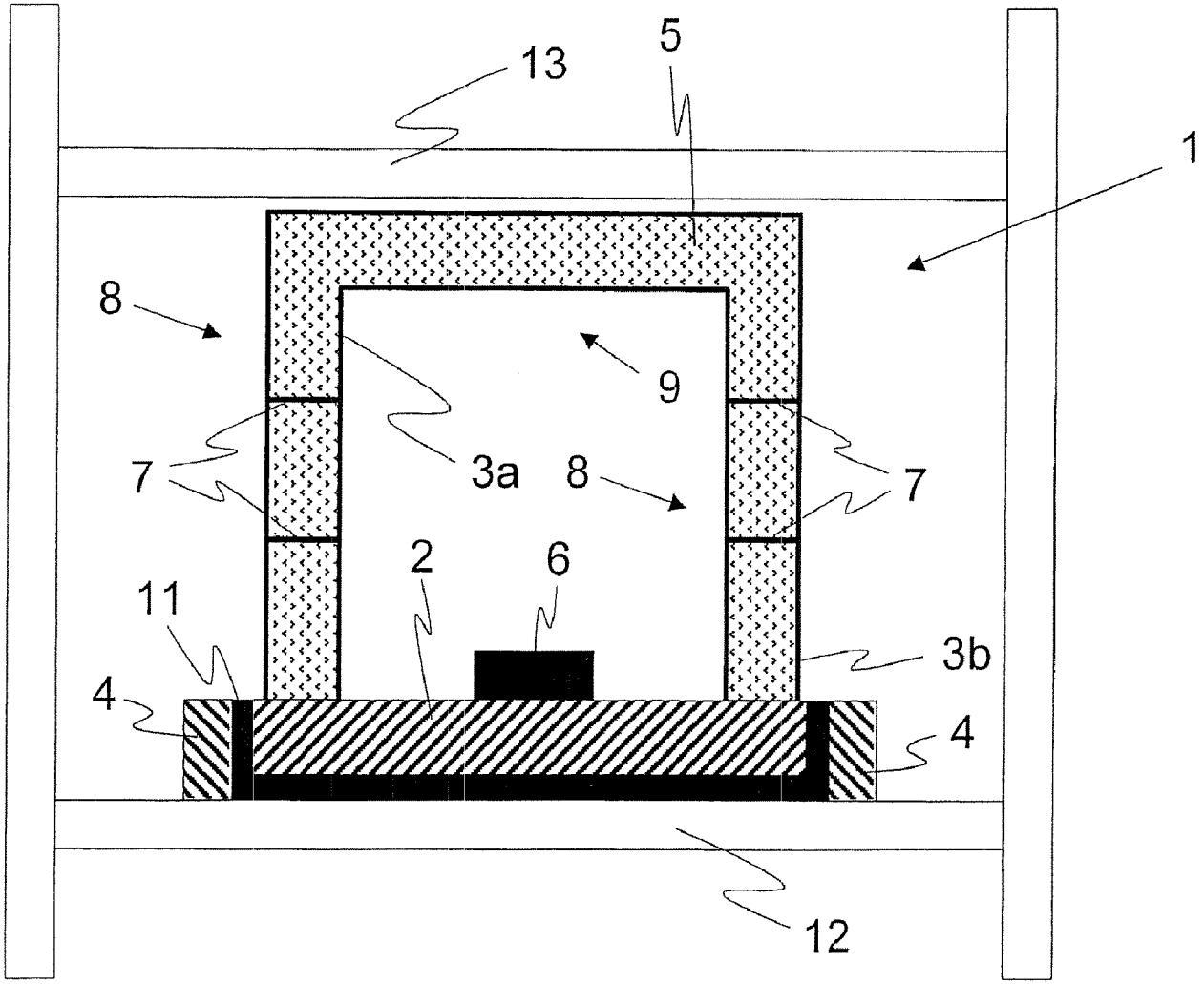
Figure 5:
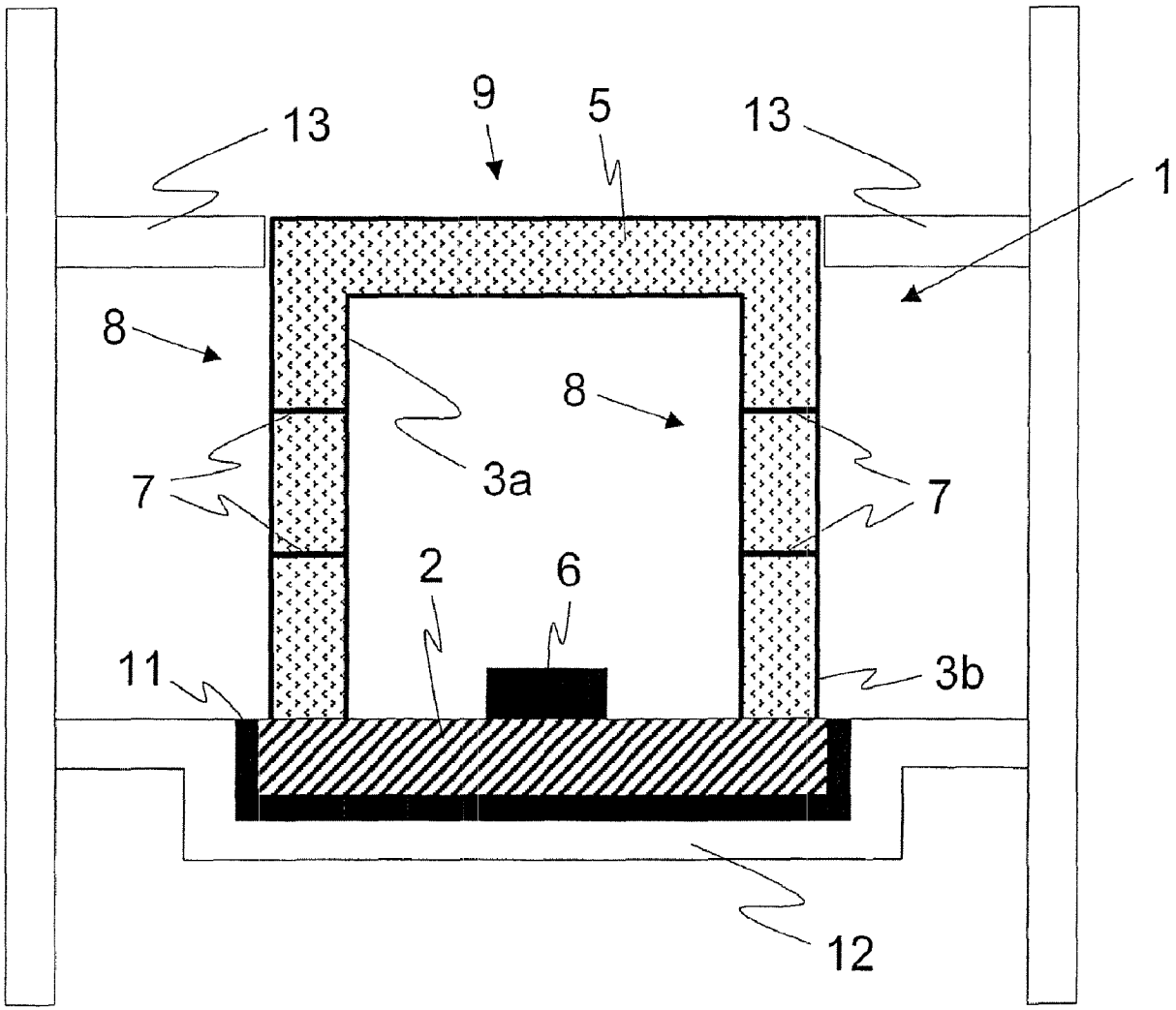
Figure 6:
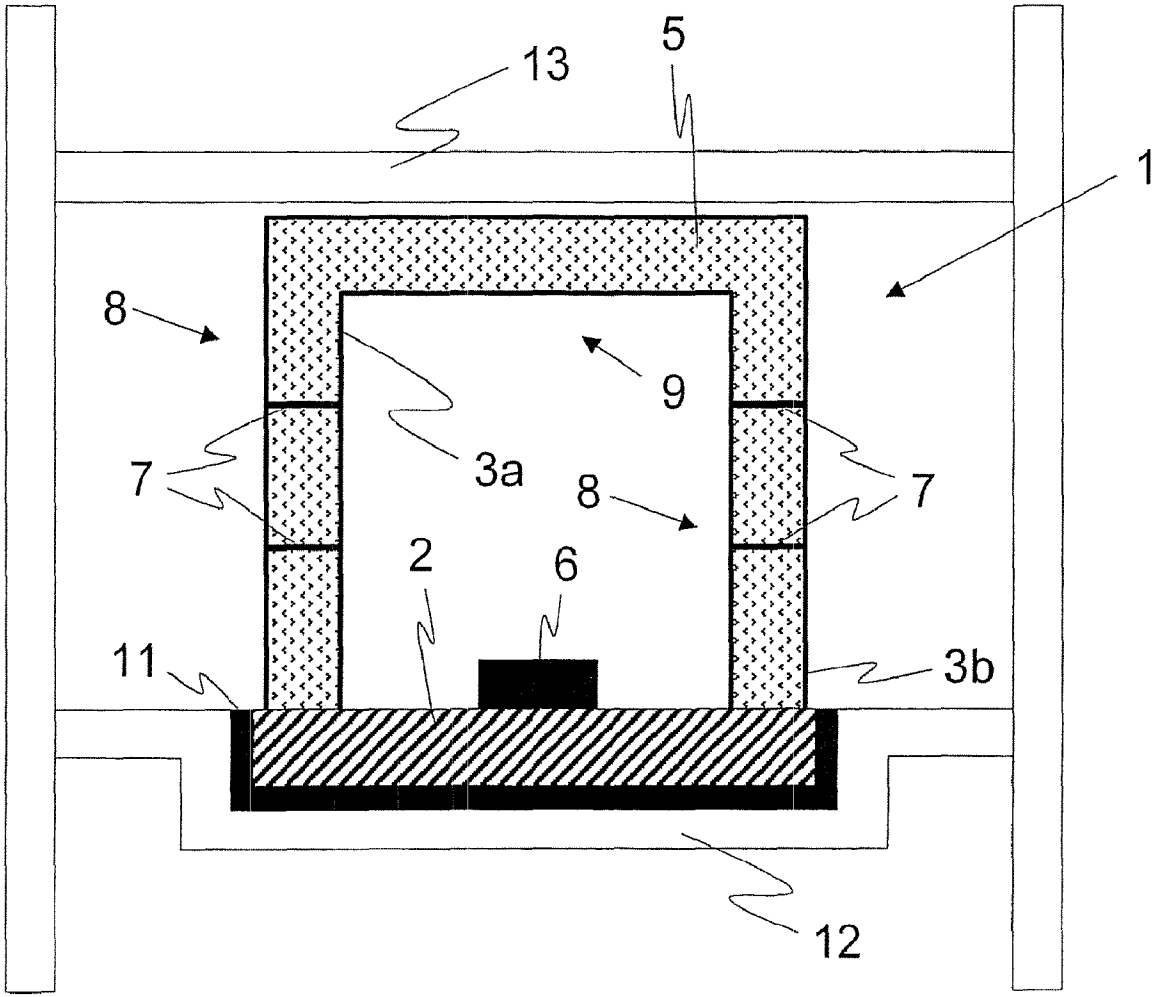
Figure 7:
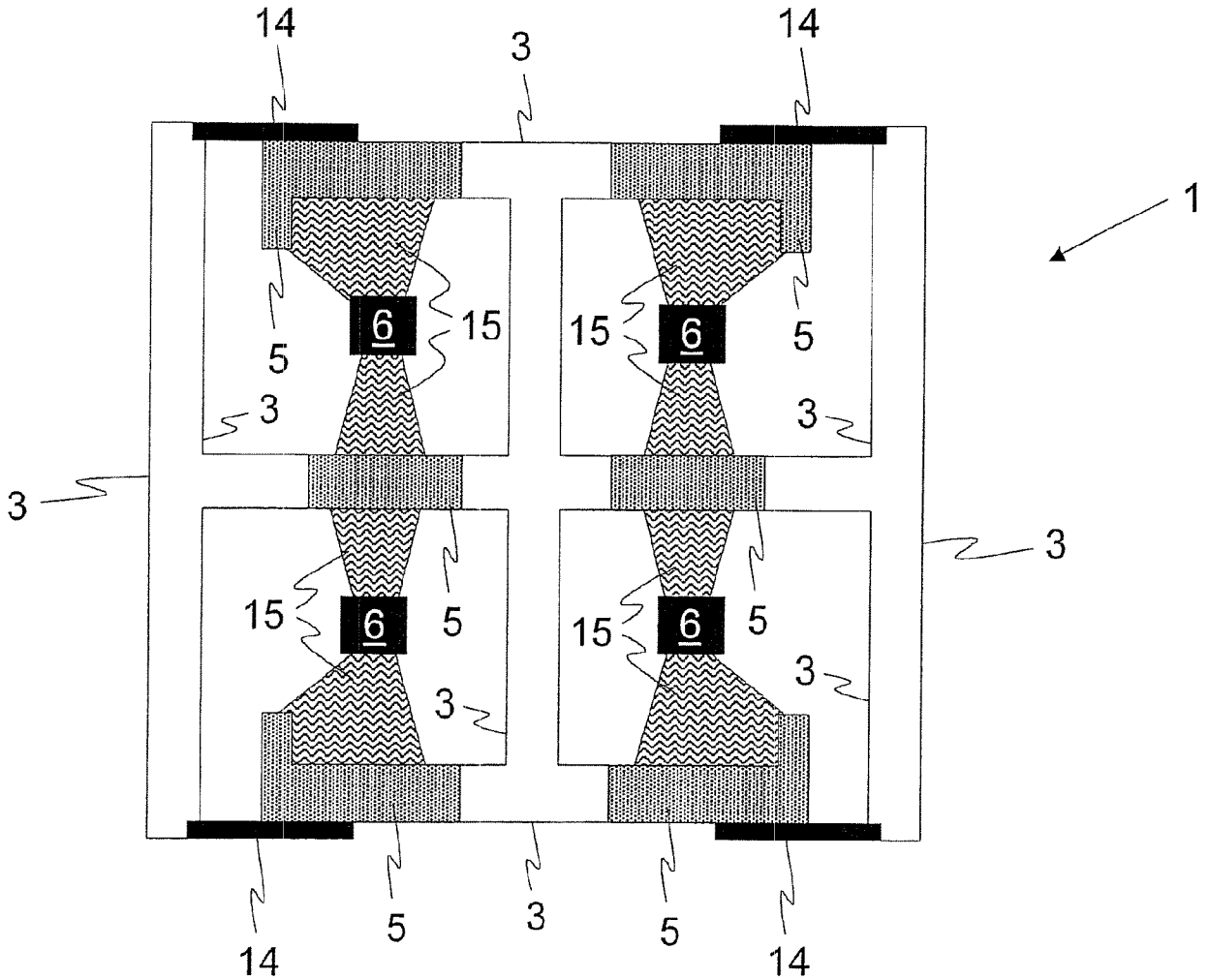
Figure 8:
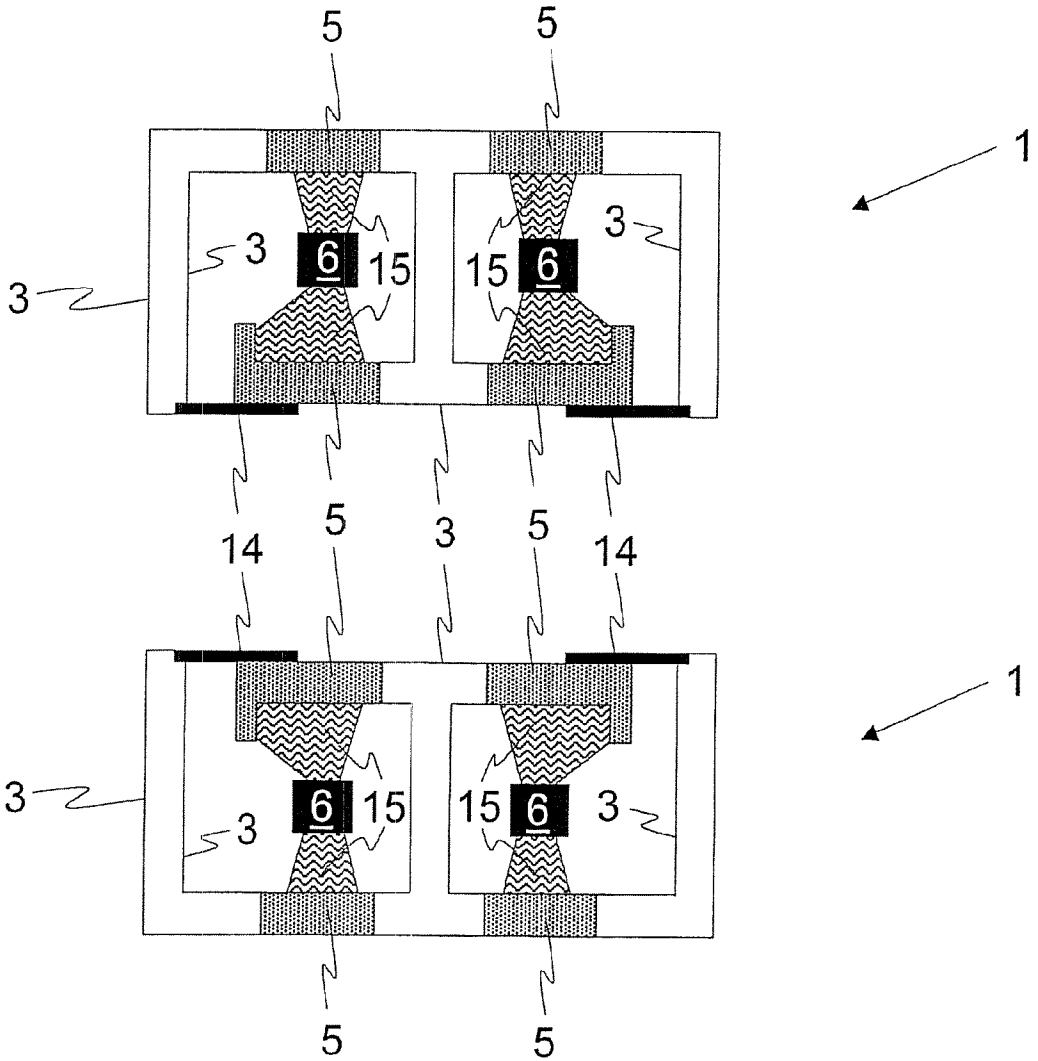
Figure 9:
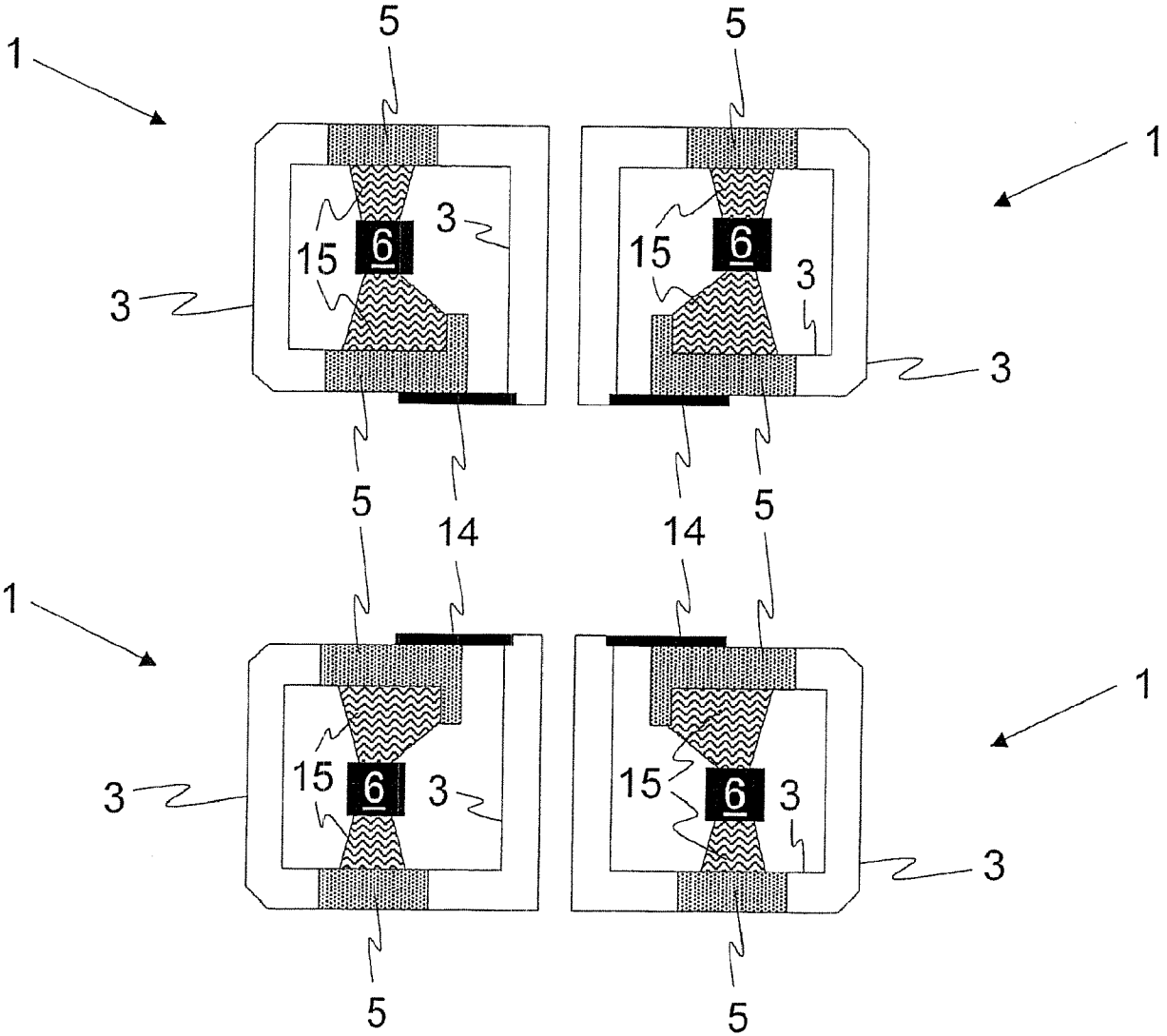
Figure 10:
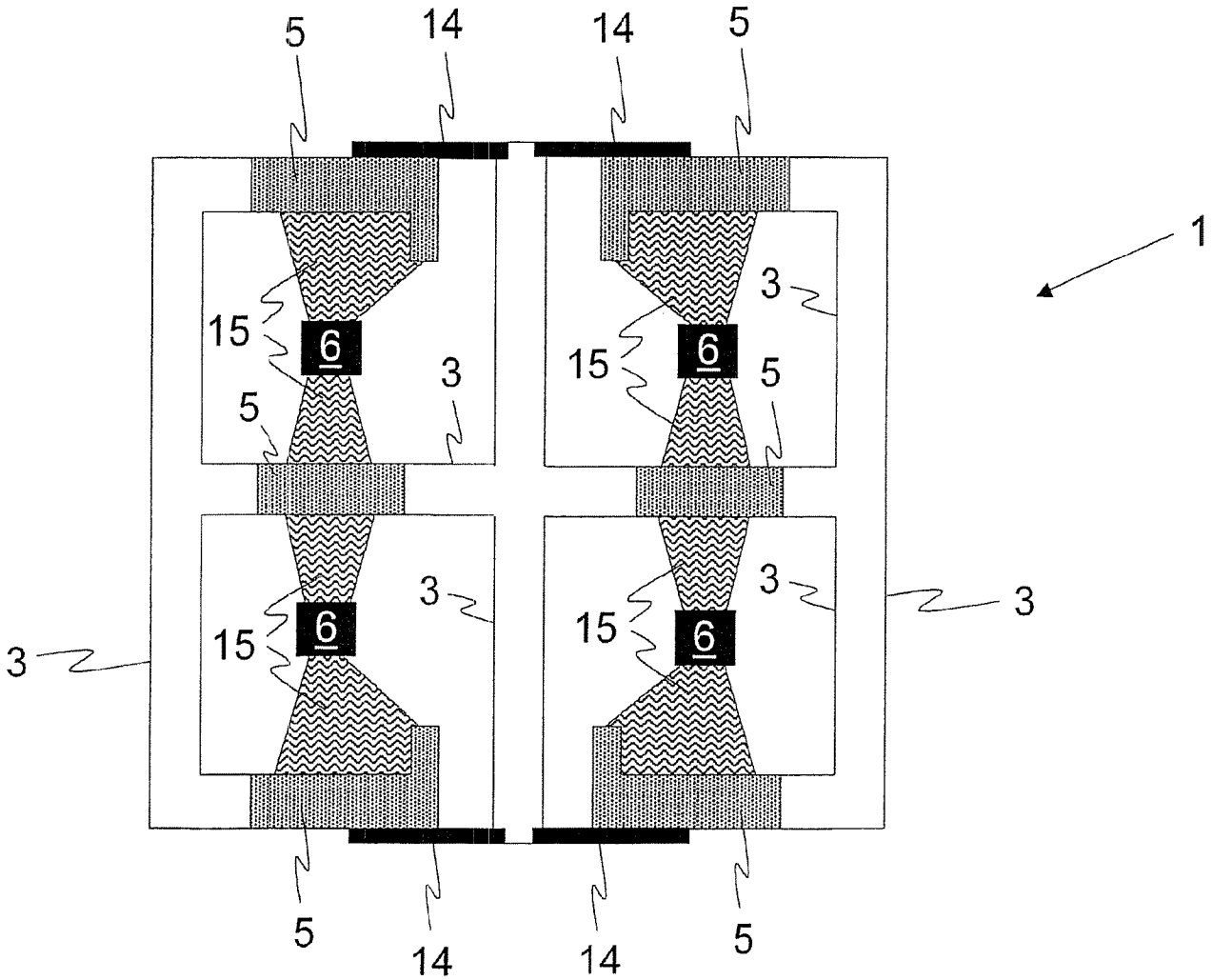
Figure 11:
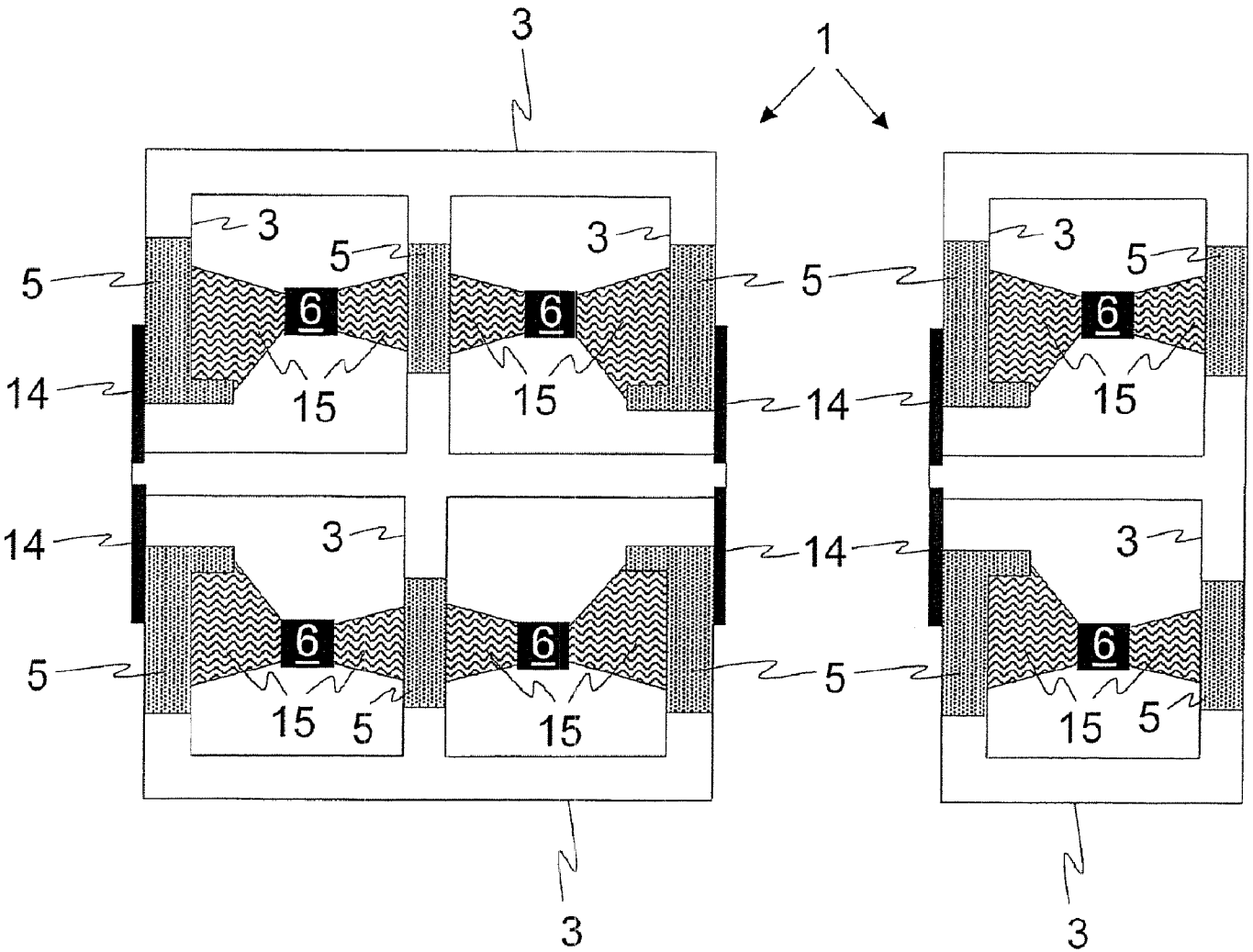
Figure 12:
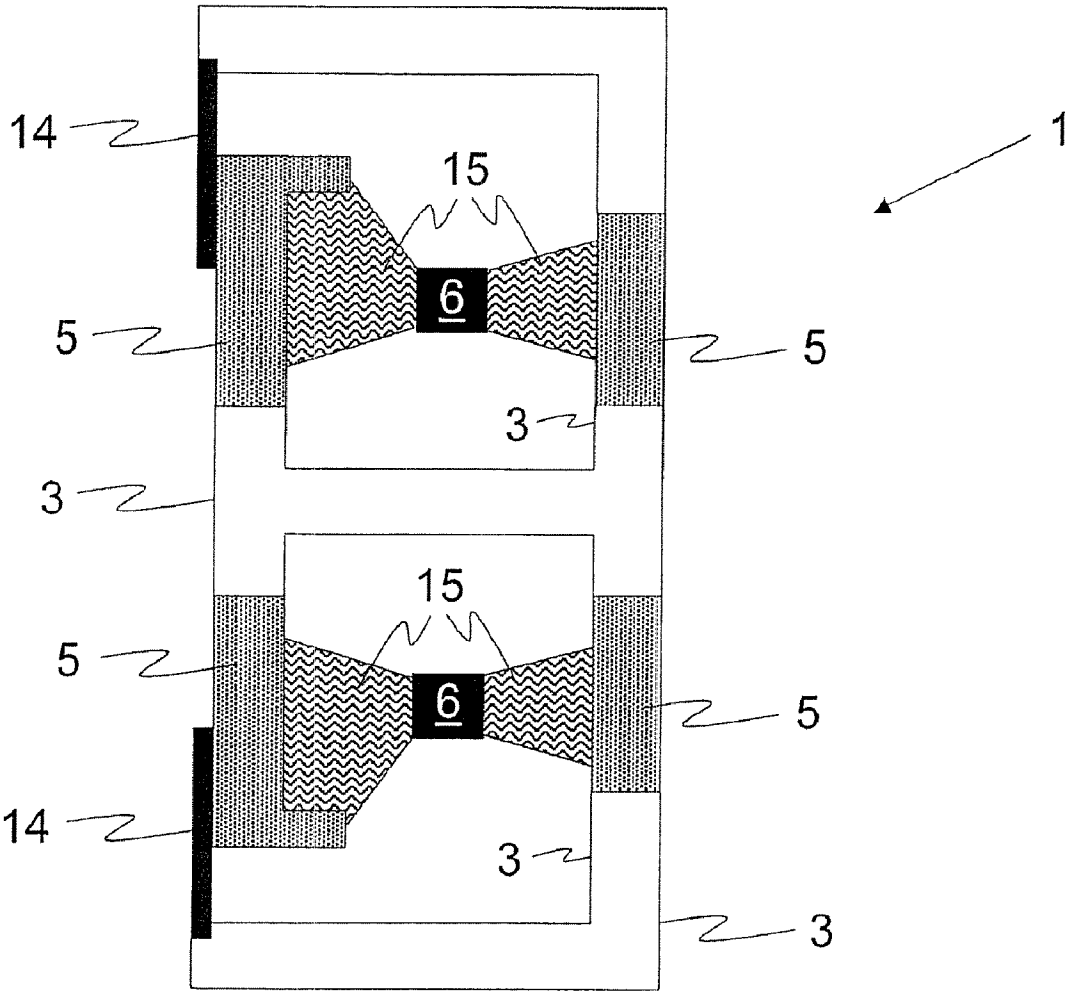
Figure 13:
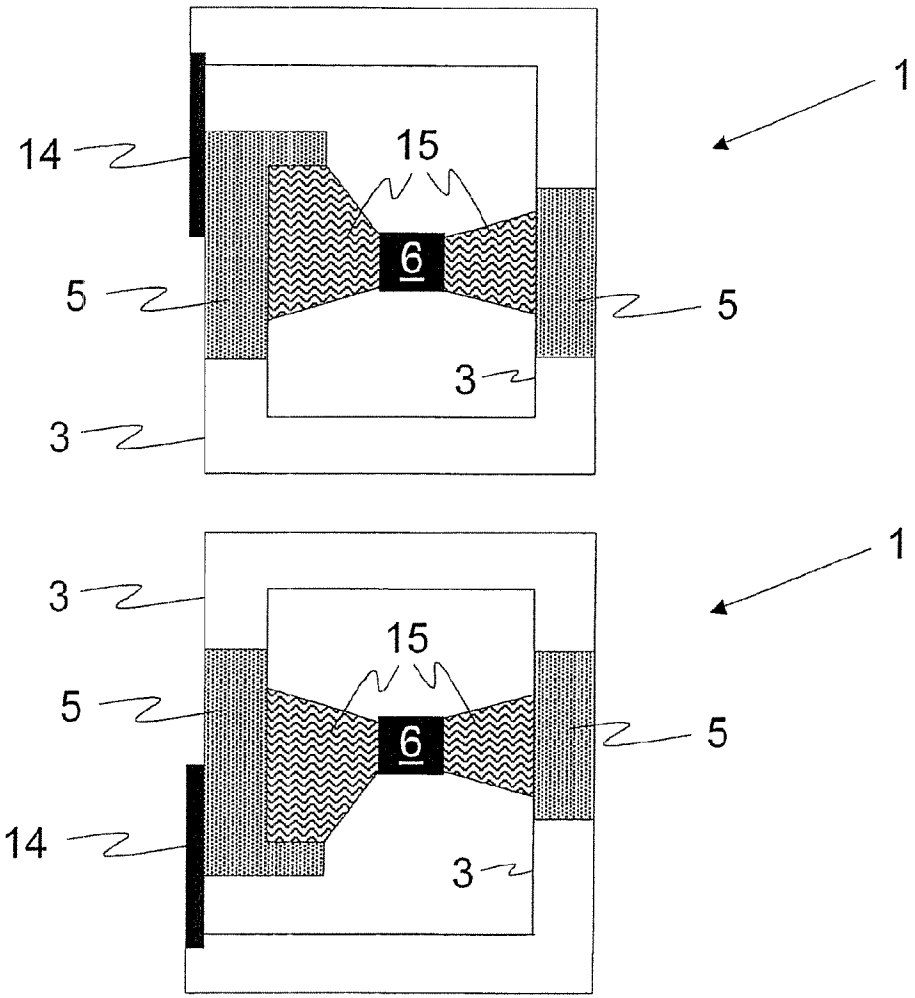

In FIGS. 4 to 6 various possibilities are illustrated for incorporating the structural element 1 according to the invention into a construction, for example a radiation shielding construction. While the structure element 1 according to FIG. 4 is arranged directly between the base plate 12 and the ceiling plate 13 of a building storey, the structure element 1 in FIG. 5 is recessed in the base plate 12 of the storey in such a way that the surface of the floor plate 2 of the structure element 1 forms a flat surface with the surface of the base plate 12 of the construction. The ceiling section 9 of the structure element 1 also penetrates the ceiling section 13 of this storey and also forms a smooth surface with this ceiling section 13. Depending on the height of the structure element 1, it is of course also possible just to integrate the structure element 1 according to FIG. 6 into the base plate 12 of the construction.

FIGS. 7 to 13 each show plan views of structure elements 1 according to the invention. All of these structure elements 1 have at least two shell elements 3, a linear accelerator 6 and an entrance region, which is fitted with a moveably mounted door unit 14.

The radiation 15 emitted by the linear accelerator 6 in the exemplary embodiments shown has only one defined dispersion region, which is identified by a corrugated shaded region. Between the shell elements 3, in each case in the area in which the radiation 15 impinges on the wall sections 8 of the structure element 1, a radiation shielding material 5 is located. The relevant regions can be separated off from the remaining regions of the wall sections 8, in which there is no radiation shielding material 5, by means of a partition wall, such that a physical boundary is assigned to the radiation shielding material 5 on all sides. It is also possible to fill the regions in which radiation shielding material 5 with particularly high radiation screening effect is not needed, with another material, for example concrete.

The shell elements 3 also have an L-shaped form in the region of the door units 14, so that the emitted radiation 15 is efficiently prevented from leaving the structure element 1, in case the door units 14 are not closed during operation of the linear accelerator 6. If necessary, the shell elements associated with the entrance region 3 can also be offset relative to each other in such a way that a labyrinth-like access results.

As FIGS. 7 to 13 further show, structural elements 1 of different geometries can be manufactured using the construction method according to the invention. Thus the shell elements 3 in the example of FIG. 9, for example, have flattened corner regions. By the use of metal, plastic and/or wood as a shell element 3, any other geometry is of course also possible, for example with concave surfaces. Design possibilities are therefore obtained which would not be possible by using the conventional method of constructing the structure elements 1 from concrete or steel-reinforced concrete.

Figure 14:
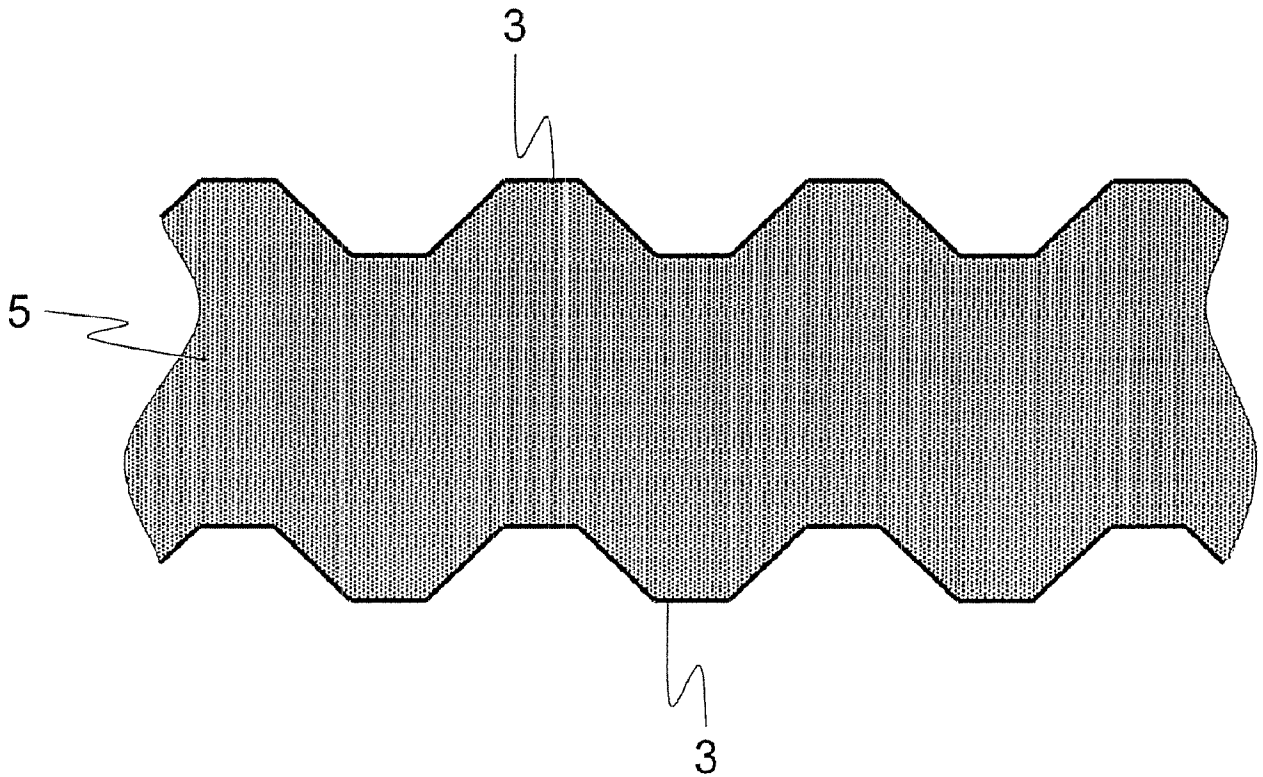

FIG. 14 shows a schematic plan view of a wall section 8, whose shell elements 3 have an essentially wave-shaped profile. This means that the stability of the shell elements 3 is considerably increased. In addition, conventional bulkheads can be used as shell elements 3, which can also be reused following dismantling of the structure element 1. In order to provide the shell elements 3 on their side facing away from the radiation shielding material 5 with a smooth, visually appealing surface, if required these regions can be provided with appropriate cladding materials, not illustrated. Suitable materials for this purpose are for example wooden panelling or plasterboard sheets, which additionally act as radiation shielding material 5. These are finally joined to the corresponding shell elements 3 in the standard way. In addition, external reinforcement beads can be sealed by welding or screwing on sheet metal boards, and also filled with radiation shielding material 5. The reinforcement beads can alternatively be fitted with normal or heavy concrete attached in a force-fitting manner, in order to obtain static reinforcement and additional radiation shielding.

Figure 15:
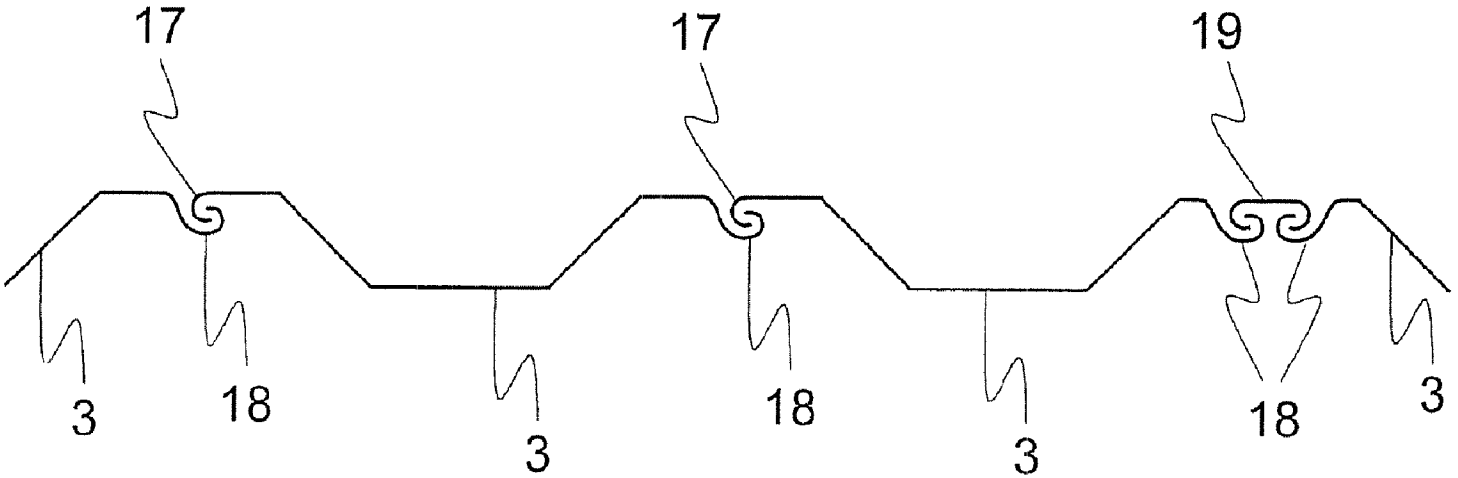

FIG. 15 shows two possible types of connection for adjacent shell elements 3, which dispense with additional means, such as for example screws or rivets. In this arrangement each of the edges of one side of the shell elements 3 have a fold 17. If the opposite side edge of the respectively adjacent shell element 3 has a corresponding hook shape 18, then both shell elements 3 can be simply hooked together, whereby a secure and yet easily detachable connection is produced. On the right-hand side, a further possibility of a connection of this type between two adjacent shell elements 3 is shown. Here the relevant edges of both shell elements 3 have a hook shape 18, over which one, or more if required, so-called omega profiles 19 are pushed from above. By combining the individual shell elements 3, these can have a defined width, which corresponds for example to the allowed width of a lorry. The costs and time for transporting them can therefore be considerably reduced. Multiple shell elements 3 can already be joined together at the production site to form a transport batch, which are then assembled together on site.

Figure 16:
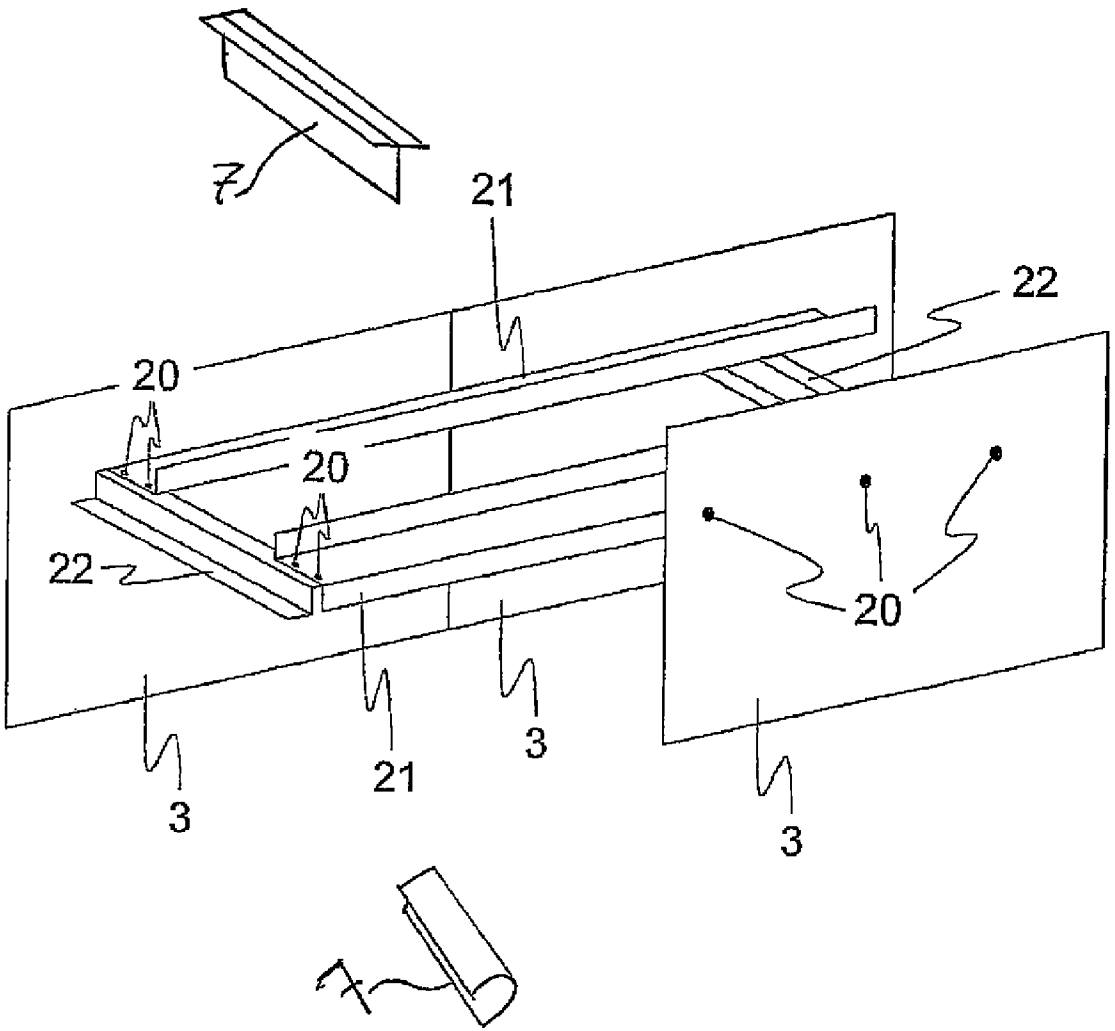

FIG. 16 shows two rear and, for the sake of clarity, only one frontal shell element 3. These are constructed as flat sheets, but of course the following also applies to profiled shell elements 3. The shell elements 3 themselves are connected together by means of indicated screw connections 20, with Z-shaped longitudinal struts 21. It goes without saying that the screw connections 20 can also be replaced by welded or riveted joints. The longitudinal struts 21 are in turn joined in the same way to other Z-shaped transverse struts 22, which act as tie-rods 7 and whose length corresponds to the spacing between the opposite shell elements 3. This produces a particularly torsion-proof connection of corresponding shell elements 3, and therefore one that ensures compressive and tensile strength. The profile of the individual struts can differ from the shape shown. For example T- or U-shaped struts are certainly not excluded, as long as they have the required stability. The length of the longitudinal struts 21 furthermore can also be chosen as desired. Accordingly, as in the example shown, two, but also more adjacent shell elements 3 can be respectively connected together. The arrangement of multiple parallel offset longitudinal struts 21 is also conceivable, in order to further increase the stability of the structure element 1. In order to avoid forming cavities between the shell elements 3 when filling with radiation shielding material 5, which would adversely affect the radiation shielding effect of the structure element 1, the longitudinal struts 21 are to be arranged in accordance with FIG. 16. As can be clearly seen, the legs of the Z-profile that point downwards are always on the side of the adjoining shell element 3. If radiation shielding material 5 is inserted between the shell elements 3 from above, then this can reliably spread below the entire longitudinal strut 21.

Figure 17:
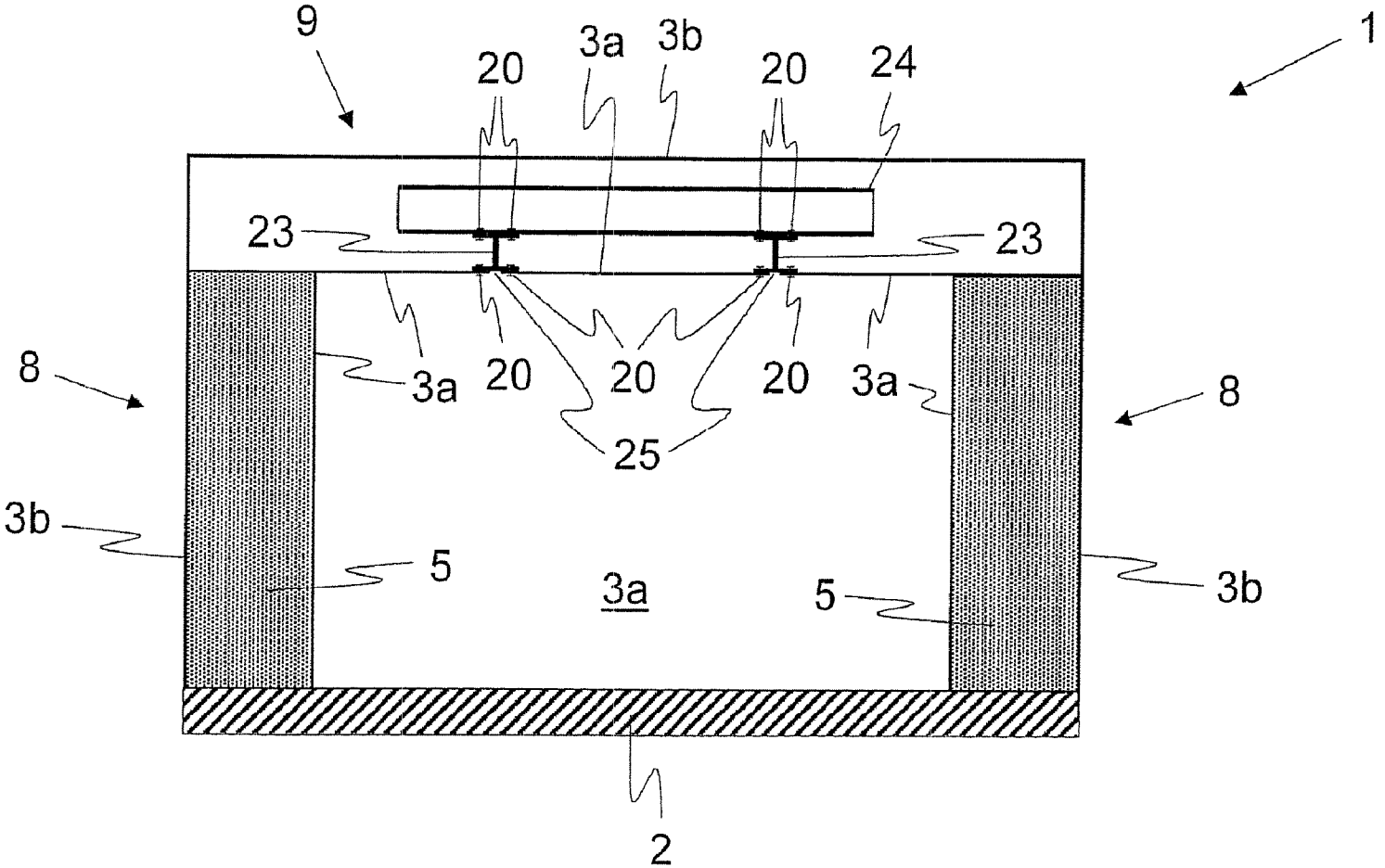

Finally, in FIG. 17 a cross-section of a structure element 1 according to the invention is shown. This has two lateral, one frontal, not shown, and one rear wall section 8, which each consist of inner shell elements 3*a*, outer shell elements 3*b* and radiation shielding material 5 lying in between them. Longitudinal bearers 23 are supported on the rear and the not shown front wall section 8, in each case lying in the plane of the drawing. Connected to the longitudinal bearers 23 in turn are transverse bearers 24 for transverse load distribution, which do not however need to project right over the lateral wall sections 8, as in the example shown. The inner shell elements 3*a* of the ceiling section 9 rest on the shell elements 3*a*, 3*b* of the lateral wall section 8. Also, they are connected to the longitudinal bearers 23, for example by means of screw connections 20. If, as in the example shown, multiple inner shell elements 3*a* are used in the region of the ceiling section 9, then it is advantageous and also useful from the point of view of radiation shielding, if the joints 25 of the inner shell elements 3*a* are located in the region of the longitudinal bearers 23. While the outer shell elements 3*b* of the wall sections 8 in FIG. 17 extend as far as the outer shell element 3*b* of the ceiling section 9, the ceiling section 9 can of course also have outer shell elements 3*b* independent of the wall sections 8. The space between the shell elements 3*a*, 3*b* in the region of the ceiling section 9 is finally filled with radiation shielding material 5, not shown, which means that the structure element 1 guarantees radiation shielding on all sides.

The present invention has been explained in further detail using exemplary embodiments. Modifications of the invention are by implication possible within the scope of the patent claims, wherein all features listed in the description and the descriptions of the drawings can be realised in any combination, as long as this appears reasonable and possible. It is therefore also possible for example that the floor plate 2 essentially has the floor plan of the walls of the construction and is laid on the base plate before the erection of the construction. The floor plate can be assembled from multiple single plates which are mounted on the base plate and for example grouted with concrete. The shell elements can then be constructed on the floor plate laid in this manner.

The invention claimed is:

1. A structure element for radiation shielding constructions in a building sized for normal human occupancy, comprising: at least one floor plate of the building, walls of the building connected to the floor plate of the building and a ceiling of the building connected to the walls, wherein at least one wall section of the building or at least one ceiling section of the building includes at least two shell elements, each shell element made of at least one of metal, plastic and/or wood and further including a layer of radiation shielding material lying between the at least two shell elements; wherein the type of the radiation shielding material varies in accordance with the type of radiation or radiation intensity.

2. Structure element according to claim 1, wherein the at least two shell elements are connected to the at least one floor plate and to additional shell elements by means of detachable connections in such a way that the structure element can be dismantled without being destroyed and thereafter can be reassembled.

3. Structure element according to claim 2, wherein the detachable connections are formed by means of angled struts.

4. Structure element according to claim 2, wherein the detachable connections include omega profiles.

5. Structure element according to claim 1, wherein the at least two shell elements have an essentially wave-shaped profile.

6. Structure element according to claim 1, wherein the at least two shell elements enclosing the radiation shielding material are connected together by detachable tie-rods arranged transversely to their longitudinal direction.

7. Structure element according to claim 6, wherein the tie-rods have one of a Z, T or U profile.

8. Structure element according to claim 1, wherein at least one of the wall sections or at least one ceiling section has a constant thickness.

9. Structure element according to claim 1, wherein the radiation shielding material contains mineral substances, which owing to their petrographic properties, in particular their atomic number and/or specific density, are suitable for radiation shielding material.

10. Structure element according to claim 1, wherein the radiation shielding material contains bound water.

11. Structure element according to claim 1, wherein the radiation shielding material contains calcium carbonate.

12. Structure element according to claim 1, wherein the radiation shielding material comprises natural unbaked calcium sulphate dihydrate.

13. Structure element according to claim 1, wherein the radiation shielding material comprises a ballast made of hardened granulated gypsum.

14. Structure element according to claim 1, wherein the radiation shielding material is compressed.

15. Structure element according to claim 1, wherein additives of materials selected from the group consisting of gibbsite, hydrargillite, aluminium hydrate and magnesium sulphate are added to the radiation shielding material.

16. Structure element according to claim 1, wherein the at least one floor plate is elastically mounted via a mounting.

17. Structure element according to claim 16, wherein the mounting comprises elastic material, at least one spring element and at least one shock absorber.

18. Structure element according to claim 1, wherein an entrance opening is defined through the walls and wall sections are arranged relative to one another in the region of the entrance opening in such a way that a labyrinth-like access is formed.

19. Structure element according to claim 1, wherein the ceiling includes at least one ceiling section that is fixed detachablyto transverse bearers and longitudinal bearers, wherein the transverse bearers or the longitudinal bearers are at least partially supported on the wall sections.

20. Construction, in particular radiation shielding construction, with at least one base plate or ceiling plate bounding a storey, wherein the construction has at least one structure element according to claim 1.

21. Construction according to claim 20, wherein the structure element is integrated into the base plate or the ceiling plate of the structure in such a way that the surface of the at least one floor plate together with the surface of the base plate, and/or the surface of the ceiling section together with the surface of the ceiling plate, form an essentially flat surface.

* * * * *